United States Patent [19]

Justus

[11] Patent Number: 4,752,214

[45] Date of Patent: Jun. 21, 1988

[54] OVEN WALL STRAIGHTENER

[75] Inventor: Paul E. Justus, Fort Wayne, Ind.

[73] Assignee: Essex Group, Inc., Fort Wayne, Ind.

[21] Appl. No.: 99,274

[22] Filed: Sep. 21, 1987

[51] Int. Cl.[4] ..... F27D 1/00; F23M 5/00

[52] U.S. Cl. ..... 432/3; 432/248; 432/247; 110/336; 52/828

[58] Field of Search ..... 432/247, 248, 251, 252, 432/121, 3; 110/336, 340; 52/827, 828

[56] References Cited

U.S. PATENT DOCUMENTS

| | | | |
|---|---|---|---|
| 1,282,862 | 10/1918 | Knox | 432/248 |
| 1,282,863 | 10/1918 | Knox | 432/248 |
| 1,865,284 | 6/1932 | Smith | 52/828 |
| 2,591,723 | 4/1952 | Sampson | 110/336 |
| 4,199,278 | 4/1980 | Koehl | 52/828 |

FOREIGN PATENT DOCUMENTS

| | | | |
|---|---|---|---|
| 2607461 | 8/1977 | Fed. Rep. of Germany | 52/827 |
| 2807000 | 8/1978 | Fed. Rep. of Germany | 52/828 |

*Primary Examiner*—Henry C. Yuen

*Attorney, Agent, or Firm*—John W. Hogan, Jr.; Harry J. Gwinnell

[57] ABSTRACT

An oven wall straightener and a method for straightening an oven wall are disclosed. An angled beam (30) is mounted in such a way that rapid heat transfer from the oven wall (10) to the vertex (35) of the angled beam (30) causes the angled beam (30) to bow away from the oven wall (10). Beam straps (50) then pull the oven wall (10) toward the angled beam (30) restoring the oven wall (10) to a relatively straightened position.

5 Claims, 1 Drawing Sheet

FIG. 1
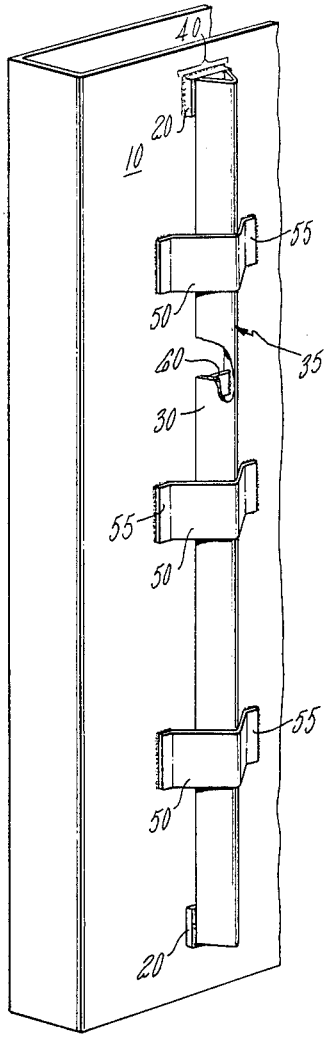
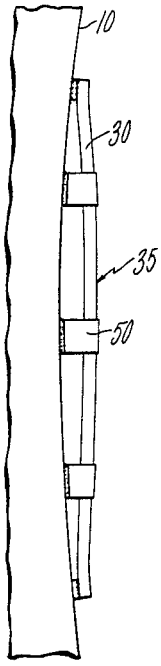
FIG. 3
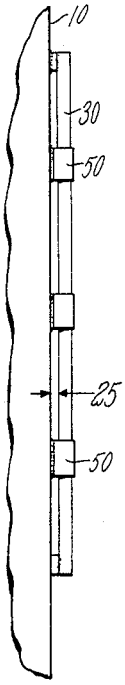
FIG. 4
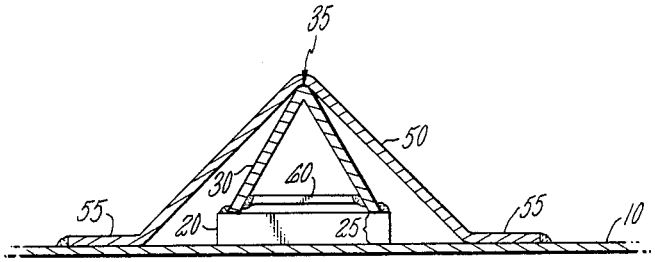
FIG. 2

OVEN WALL STRAIGHTENER

DESCRIPTION

TECHNICAL FIELD

This invention relates to ovens, more particularly, metal walled ovens adapted for coating wire.

BACKGROUND ART

The production of multi-coated wires, i.e., those wires having a plurality of coats of insulating material, is produced by applying a plurality of coats of insulating material in layers onto a wire. Commonly, the individual coats of insulating material are applied by first passing the wire through an "enamel coating apparatus" and then the coat is dried by passing the wire through a high temperature "drying and curing" oven.

Typically, the ovens are tall, vertical free standing structures with walls made of stainless steel sheet metal and plates. One problem experienced is that the metal tends to buckle or bow inward, toward the direction of the wire, because of a large temperature gradient between the hot interior surface and the colder exterior surface. This tends to diminish the width of an already narrow wire passageway (work tube) oven and increases the probability of rubbing uncured enamel breaking or stripping the wires which are passing through the oven thereby degrading the product wire. With age this problem increases because with each heat-up the oven wall bows more toward the oven interior since there has been no force to restore the wall to its original position.

Typical solutions in the past have been to use long, slow heat-up times so as to hold the temperature gradient across the material low or a design of a heavy rigid frame with supports attached to the wall of the duct. However, the first solution, by its very nature, is very slow and time consuming and the second solution creates problems with thermal expansion of the duct.

Accordingly, what is needed in the art is a method which allows for quick heat-up of the oven while preventing the buckling of the oven wall toward the wire.

DISCLOSURE OF THE INVENTION

An oven wall straightener and a method of straightening an oven wall are disclosed. In order to maintain a relatively straightened oven wall, an angled beam is mounted in a particular manner to the oven wall. The angled beam, shaped as an inverted "V", optionally with a plurality of cross ties to prevent spreading under load, is secured at only one end, allowing the other end to slide and thermally expand. A plurality of insulating pads are mounted between the oven wall and the angled beam to allow an air gap to insulate the beam from the heat of the oven wall. The angled beam is strapped to the oven wall by a plurality of beam straps which are secured to the oven wall and contact the angled beam only at the vertex or spine of the angled beam. Rapid heat transfer through the beam straps to the contacted portion of the angled beam's spine causes the angled beam to bow in the opposite direction than that of the oven wall thereby setting up restoring forces to prevent the oven wall from bowing inwardly and to hold the oven wall in a relatively straightened position.

Other features and advantages will be apparent from the specification and claims and from the accompanying drawings which illustrate an embodiment of the invention.

BRIEF DESCRIPTION OF THE DRAWINGS

FIG. 1 shows a front view of an oven wall with a formed angle beam strapped to it;

FIG. 2 shows a cross section of the angled beam;

FIG. 3 shows an exaggerated view of the effect of heat upon the oven wall and a counter effect of the formed angled beam; and FIG. 4 shows a side view of the oven wall and the formed angle beam and straps.

BEST MODE FOR CARRYING OUT THE INVENTION

Referring to FIG. 1, it can be seen that there is an exterior of an oven wall 10 typical of those used in the magnet wire production process. The formed angled beam 30 is strapped to the oven wall 10 by beam straps 50 and attached by securing means 40. The angled beam 30 can be made of any metal or alloy, with stainless steel being preferred for strength reasons. The angled beam 30 is formed by bending a flat piece of metal into the desired angled shape. The angle can be any reasonable angle size, about 15° to about 165° is typical. Preferred range is about 45° to about 120°, with 60° being the most preferred angle for strength reasons. The angled beam 30 extends vertically along the oven wall 10 with the vertex 35 (i.e., angle juncture or spine) running in parallel opposition to the oven wall 10 as shown. The beam is secured at one end 40 by any securing means, for example, rivet, weld, or hinge. The angled beam is attached at only one end either top or bottom (but not both), so that any increase or decrease in its length due to flexure, expansion or contraction will not adversely affect the oven wall 10. Insulating pads 20, which assure that there is an insulation gap between the oven wall 10 and the angled beam 30, are preferably made of a non-heat-conducting material for example conventional ceramic material. Cross ties 60 prevent the angled beam from spreading under load.

FIG. 2 shows a cross sectional view of the angled beam 30. The angled beam 30 has a cross section in the shape of an equilateral triangle where the legs of the equilateral triangle are the two sides of the formed angled beam 30 and a cross tie 60 which faces the oven wall 10. An equilateral triangle (60° angle) is preferred because force is distributed equally making the equilateral triangle the strongest. The cross tie 60 is attached to the two sides of the angled beam, forming a triangle, and helps prevent spreading under load. The cross tie 60 is typically made of a strong material preferably a metal such as stainless steel or other high temperature alloys. The cross tie 60 can be attached in any way, typically by rivet or weld. Preferably there are a plurality of cross ties 60, however the cross ties 60 can be replaced by using a triangular beam in which case one of the sides of the triangular beam would be serving the same function as a single continuous cross tie. There is an insulation gap 25 between the angled beam 30 and the oven wall 10 because of the insulating pads 20. This insulation gap 25 (see also FIG. 4) of air space (or insulation pad) is important because it acts to insulate the angled beam 30 from the heat of the oven. If the insulation gap 25 were not present, then the angled beam 30 would be in contact with the oven wall 10 and the angled beam 30 would tend to bow inward in the same direction as the oven wall 10, defeating the purpose of the present invention.

Also shown in FIG. 2 is also one of the beam straps 50 which is fastened to the oven wall by means such as rivet, spot welding, or other securing means at the two ends 55, or preferably a continuous weld along the entire contact surface length of the strap to provide for a greater area of heat flow along the length of the strap to the vertex 35 of the beam 30. As shown, the beam strap 50 straddles the angled beam 30 i.e., the beam strap 50 is secured to the oven wall at one end 55, contacts the vertex 35 of the formed angled beam, and then continues downward proximally on the other side of the angled beam where the other end 55 of the beam strap 50 is attached to the oven wall 10. The beam strap 50 contacts the angled beam at the vertex 35 only. The strap is shown in the Figures with a flattened end section lying against the oven wall which is particularly preferred if rivets or spot welding is used to increase the heat transfer cross-sectional area of the strap.

FIG. 3 shows an exaggerated view of the effect of heat upon the oven wall 10 and the counter effect of the formed angled beam 30. As seen, the oven wall 10 bows inward due to the expansion of the metal because of the temperature gradient across the oven wall 10. Conversely, the angled beam 30 flexes in the opposite direction because the beam strap 50 conducts the heat from the oven to the vertex 35 of the angled beam more quickly than the heat is transferred through the insulation gap 25 to the sloping sides or legs of the angled beam thereby causing the angled beam 30 to flex outward. For this reason, it is preferred that the beam straps 50 be made of a very heat conductive material. It is also preferred that they be strong because as the angled beam 30 flexes in the opposite direction to the oven wall 10, the beam straps 50 pull the oven wall 10 toward the angled beam 30, to effectively straighten the oven wall 10. Typically the beam straps will be metal, with iron, or stainless steel or other conventional high temperature strength alloy being preferred.

FIG. 4 illustrates the beam straps 50, angled beam 30 and the oven wall 10. In FIG. 4, the oven wall has been effectively straightened because of the restorative force of the angled beam 30 and the beam straps 50. Such a straightened wall is the desired object of this invention, since a flexed wall tends to diminish the width of an oven which is already substantially narrow and increases the risk of breaking or stripping the wires which are passing through the oven.

It should be understood that the invention is not limited to the particular embodiments shown and described herein, but that various changes and modifications may be made without departing from the spirit and scope of this novel concept as defined by the following claims.

I claim:

1. An oven particularly adapted for heating wire comprising a heat source and oven walls to contain heat generated by the heat source, wherein the improvement comprises at least one oven wall having an oven wall straightener, the oven wall straightener comprising:

a. an angled beam having two sloping sides and a vertex;

b. means to secure one end of the angled beam to a portion of an oven wall such that the angled beam extends vertically along the oven wall with the vertex of the beam running in parallel opposition to the oven wall;

c. a plurality of insulating pads separating the angled beam from the oven wall;

d. a plurality of beam straps located at spaced intervals along the vertex of the angled beam, each beam strap having a first end, and a second end wherein the first end is attached to the oven wall proximally to one side of the angled beam and the second end is attached to the oven wall proximally to the other side of the angled beam such that the beam strap contacts the angled beam only at the vertex of the angled beam; wherein the beam straps can conduct heat to the vertex of the angled beam causing the angled beam to bow outward away from the oven wall thereby preventing the oven wall from bowing inwardly.

2. The oven of claim 1 wherein the oven wall straightener further comprises at least one cross tie attached to the angled beam between the sides of the angled beam to prevent spreading under load.

3. An oven as claimed in claim 2 in which the angled beam and the cross tie form an equilateral triangle.

4. An oven as claimed in claim 1 wherein the beam straps are made of a heat conductive metal.

5. A method preventing an oven wall from bowing during heating comprising:

a. securing one end of an angled beam having a vertex formed by two sloping sides to a portion of the oven wall so that the angled beam extends vertically along the oven wall with the vertex of the angled beam running in parallel opposition to the oven wall;

b. separating the angled beam from the oven wall by a plurality of insulating pads;

c. attaching a plurality of beam straps to the oven wall, the beam straps contacting the angled beam at the vertex only; wherein the beam straps can conduct heat to the vertex of the angled beam causing the angled beam to bow outward away from the oven wall thereby preventing the oven wall from bowing inwardly.

* * * * *